United States Patent [19]

Fishgal

[11] 4,372,491

[45] Feb. 8, 1983

[54] FUEL-FEED SYSTEM

[76] Inventor: Semyon I. Fishgal, 1908-35 High Park Ave., Toronto, M6P 2R6, Canada

[21] Appl. No.: 14,848

[22] Filed: Feb. 26, 1979

[51] Int. Cl.[3] ..... B05B 3/14

[52] U.S. Cl. ..... 239/102; 261/DIG. 48

[58] Field of Search ..... 239/102; 261/DIG. 48; 210/416 F, DIG. 22, 416.4; 310/358, 369, 353

[56] References Cited

U.S. PATENT DOCUMENTS

| | | | |
|---|---|---|---|
| 3,463,321 | 8/1969 | Van Ingen | 210/DIG. 22 |
| 3,729,138 | 4/1973 | Tysk | 239/102 |
| 3,949,938 | 4/1976 | Goodinge | 239/102 |
| 4,013,223 | 3/1977 | Martin | 239/102 |
| 4,038,348 | 7/1977 | Kompanek | 239/102 X |
| 4,067,496 | 1/1978 | Martin | 239/102 |
| 4,100,798 | 7/1978 | Nilsson | 310/369 X |

*Primary Examiner*—Richard A. Schacher

[57] ABSTRACT

A fuel-feed system for engines, gas turbines, burners and the like, including a fuel pressure source communicated with a fuel tank and a porous piezoelectric ceramic filtering element, such as barium titanate, connected to a generator of electric oscillations and placed into a housing which inlet and outlet are separated by said element.

The latter can be shaped as a hollow needle of a fuel-injector valve, said outlet equipped with a valve seat interacting with a free end of said element.

2 Claims, 2 Drawing Figures

FUEL-FEED SYSTEM

BACKGROUND OF THE INVENTION

This invention relates to fuel-feed systems for engines, gas turbines, burners and the like, including a fuel pressure source communicated with a fuel tank and a means for maintaining the working properties of fuel.

The latter means in known such systems (Charles Fayette Taylor, The Internal Combustion Engine in Theory and Practice, The MIT Press, Cambridge, Mass, 1966; K. Abrosimov, A. Bromberg, F. Katayev, Road-Making Machinery, Mir Publishers, Moscow, 1972; M Khovakh, Motor-Vehicle Engines, Mir Publishers, Moscow, 1971; B. Gelman and M. Moskvin, Farm Tractors, Mir Publishers, Moscow, 1975; U.S. Pat. No. 3,441,871, etc.) removes solid contaminants from fuel by filtering, straining, gravitational displacement, centrifugal separation, etc. with full flow and bypass (5–20% of the flow).

Especially rigid requirements to filtration are for fuel-injection engines and gas turbines. Of the latters, the problem particularly arises in road-vehicle gas turbines because the parts of their fuel-feed systems are many times smaller (in comparison with those of aircraft) with openings susceptible to blockage through dirt ingress and carbon deposit formation.

Being unable to remove all solid contaminants from fuel, said known solids-removing means are assumed to be qualified if the size of the removed solids is more than the clearance in sliding pairs or openings. In many cases this is achieved by fine-mesh bypass filters consuming much energy and requiring their frequent changes because of their clogging and, in some areas, becoming a repository for biological growth.

SUMMARY OF THE INVENTION

The objective of the present invention is to relieve the requirements to filtration not only without increasing harmful effects of contaminants, but with improving the working properties of fuel.

Above objective is attained thanks to that said means for maintaining the working properties of fuel constitutes a porous piezoelectric ceramic filtering element, such as barium titanate, connected to a generator of electric oscillations and placed into a housing which inlet and outlet are separated by said element.

Thus, besides a filter, the latter represents also an (ultra)sonic transducer eliminating clogging, allowing the significant increase of the size of the calibrating channels, breaking down contaminants to a non-interfering particle size (less than said clearance or openings). Also, the ultrasonic transducer of the present invention has known emulsifying action and, therefore, can produce alcohol-fuel and water-in-fuel emulsions for fuel economy and decreasing air pollution (these effects of said fuel mixtures are well known and, therefore, not discussed here).

So, the present invention not only diminishes as it is too rigid requirements to filtration, but provides the possibility for fuel economy and decreasing air pollution. Tests showed at least 20% fuel economy, savings in maintenance, filter changes and vehicle down time.

Therefore, the present invention would have considerable effect on the country's economy and her balance of payments.

Still another advantage is combining of said piezoelectric element with a fuel-injector valve. For this the element is shaped as a hollow needle of the valve. This decrease the quantity of components of fuel-feed systems and diminutives the size of fuel droplets for better atomizing and combustion.

DESCRIPTION OF THE PREFERRED EMBODIMENTS

Figure 1:
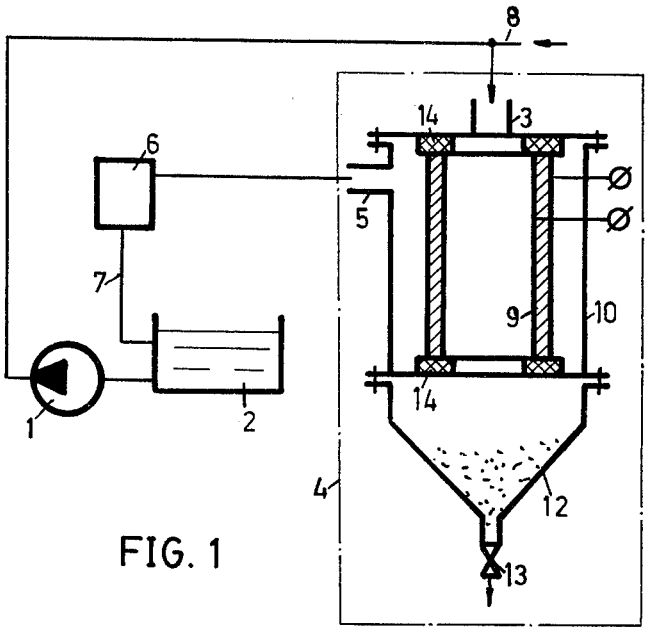
FIG. 1 is a schematic representation of a fuel-feed system of the present invention with a separate means for maintaining the working properties of fuel.

A fuel-feed system of the present invention includes a fuel pressure source 1, e.g. a pump, which inlet communicates with a fuel tank 2 and which outlet communicates with the inlet 3 of a means 4 for maintaining the working properties of fuel. The outlet 5 of the means 4 is connected to a machine 6 (FIG. 1), such as an engine, a gas turbine, a burner and the like. The excess of the delivered fuel from the machine 6 enters the tank 2 via a conduit 7.

In order to use mixtures of fuel, water, alcohol, etc., an additional conduit 8 is shown in way of illustration.

Along with the means 4, a conventional coarse full-flow filter (not shown) can be also used in the system.

The means 4 for maintaining the working properties of fuel constitutes a porous piezoelectric ceramic filtering element 9, such as barium titanate, placed into a housing 10 which inlet 3 and outlet 5 are separated by the element 9.

The latter is shaped as a hollow cylinder with its internal and external lateral surfaces coated with a metallic conductor, e.g. silver or copper. The metallized surfaces are connected to a generator of electric oscillations (not shown).

The housing 10 is provided with a sediment bowl 12 and a valve 13 (FIG. 1).

Germetization of the element 9 in the housing 10 is achieved with sealings 14.

During operation, fuel is pumped from the tank 2 through the means 4 (the inlet 3—the housing 10—the outlet 5) into the machine 6 from which the excess of the fuel is delivered back into the tank 2 via the conduit 7.

The means 4 for maintaining the working properties of fuel performs several functions.

As any filter does, it separates foreign matter from the fuel entering the machine 6. Being also an (ultra)sonic transducer, the filtering element 9 is not clogged because of an acoustic barrier near the vibrating surfaces. At working frequencies above 25 kilocycles, the coagulating action of ultrasonics settles down the contaminants into the sediment bowl 12, from which they are periodically removed through the valve 13. The transducer also breaks down solid contaminants (to a non-interfering size—less than clearance in sliding pairs) and liquid particles of fuel-mixture components by means of mechanical impacts and cavitation, dispersing the small particles into the fuel and thus preparing fuel emulsions for better combustion.

The physical changes induced by intense ultrasonic radiation are caused by heat, cavitation, steady ultrasonic forces (weak, however, compared with the cavitation forces) and large mechanical stresses (due to cavitation and ultrasonic waves).

The solids suspended in fuel scatter some incidental radiation, thereby giving rise to an energy density gradient across themselves. The solids smaller than a wavelength, the resulting radiation pressure is small (unless they are in a standing wave system and tend to accumulate there in bands situated half a wavelength apart).

Besides an alternating wave force, the solids and liquid particles are subjected to a steady force arising since the viscosity of liquid does not remain constant over a pressure cycle with temperature variations.

The motion of the particles depends on their size and mass (larger particles oscillate with a smaller amplitude). The amplitude difference also increases probability of mutual collision of particles.

The element 9 can work in cavitation regime. Cavities collapsing, liquid particles move to the bubble center with a great speed. As a result, their kinetic energy causes local hydraulic impacts accompanied by high temperature and pressure. Foreign particles are cavitation nuclei, the pressure pulses generated right where needed for their break-down. Therefore, the energy transferred directly with minimum divergence. The required energy is relatively modest, but concentrated over a small area and produces very high local stresses.

It is precisely the dispersion effect of the element 9 that allows to achieve the effects mentioned in the Summary of the Invention.

Figure 2:
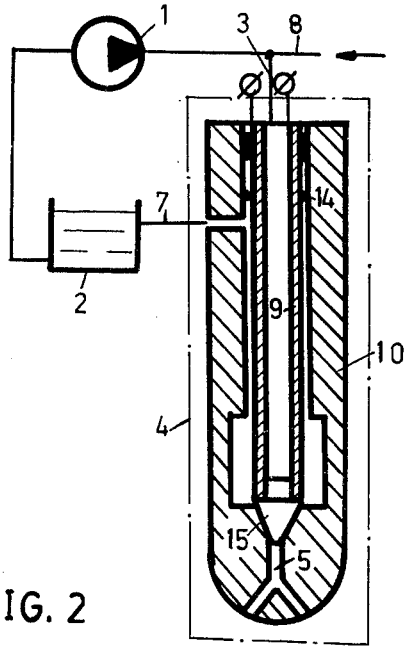
FIG. 2 is the same as above, with said means combined with a fuel-injector valve.

In FIG. 2 the means 4 is combined with a fuel-injector valve, the element 9 shaped as a hollow needle with its free conical end 15 interacting with a valve seat at the outlet 5.

Here, besides described functions, the element 9 contracted longitudinally under an electric potential across its wall lifts its cone tip 15 away from the seat, the fuel injection into a combustion chamber (not shown) provided.

Self-evidently, such a combined construction is much simplier than conventional fuel-feed systems and provides better atomizing and combustion.

It is obvious that many modifications and adaptations can be made without departing from the spirit and scope of the invention.

What is claimed is:

1. A fuel-feed system for engines, gas turbines, burners and the like, including a fuel-pressure source communicated with a reservour means and a flow-line filtration system comprising a housing having a fuel inlet port and a fuel outlet port, a porous piezoelectric ceramic filtering element having working surfaces thereon and located in the housing in the flow path of the fuel, partitioning the housing into an input part and an output part, a metallic coating on said working surfaces, and a generator of electric oscillations connected to said metallic coating whereby foreign matter in the fuel is removed by the filter and vibration of the filter effected by the generator of electric oscillations prevents clogging of the filter and emulsifies the fuel.

2. The fuel-feed system of claim 1 wherein said filtering element is shaped as a hollow needle of a fuel-injector valve, said fuel outlet port being equipped with a valve seat interacting with a free end of said element whereby the vibration of the latter, besides the above effects, diminutives the size of fuel droplets for better atomizing and combustion.

* * * * *